US006347429B1

(12) United States Patent
Hult et al.

(10) Patent No.: US 6,347,429 B1
(45) Date of Patent: Feb. 19, 2002

(54) WET/DRY VACUUM DRAIN SYSTEM

(75) Inventors: David R. Hult; Jeffrey L. Young, both of St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/369,950

(22) Filed: Aug. 6, 1999

Related U.S. Application Data

(60) Provisional application No. 60/098,578, filed on Aug. 31, 1998.

(51) Int. Cl.[7] ..... A47L 9/00

(52) U.S. Cl. ..... 15/327.2; 15/353

(58) Field of Search ..... 15/323, 327.1, 15/327.2, 327.6, 327.7, 353; D32/21–24; 220/604, 608, 605, 630, 661

(56) References Cited

U.S. PATENT DOCUMENTS 3,775,951 A * 12/1973 Eicholz et al. ..... 15/353
4,196,492 A * 4/1980 Johnson et al. ..... 15/353
4,466,155 A * 8/1984 Grave ..... 15/353
4,858,269 A * 8/1989 Ostroski et al. ..... 15/353
5,232,120 A * 8/1993 Dunken et al.
5,253,777 A * 10/1993 Schutz
5,313,686 A * 5/1994 Berfield ..... 16/327.6
5,385,233 A * 1/1995 McKibben et al.
5,388,301 A * 2/1995 Bosyj et al. ..... 15/353
5,555,600 A * 9/1996 Corson ..... 15/353
5,606,769 A * 3/1997 Tomasiak et al. ..... 15/327.6
5,954,863 A * 9/1999 Loveless et al. ..... 15/353

* cited by examiner

*Primary Examiner*—Terrence R. Till
(74) *Attorney, Agent, or Firm*—Howrey Simon Arnold & White, LLP

(57) ABSTRACT

A drain system for a wet/dry vacuum, including: a generally U-shaped dolly having wheels mounted thereon for rotation; a collection drum having an inside bottom surface defining a plane, the collection drum adapted to be mounted to the dolly; a drain opening defined by the collection drum, the drain opening defines an inside lower surface, the inside lower surface generally in line with the plane defined by the inside bottom surface of the collection drum and the drain opening being positioned generally opposite the closed end of the U-shaped dolly; and a cap having first and second ends, the first end adapted to mate with the drain opening in a sealed manner, the second end defines a member adapted to extend out from the collection drum, the member has a length sufficient to prevent the collection drum from completely tipping over.

18 Claims, 8 Drawing Sheets

FIG. 5c
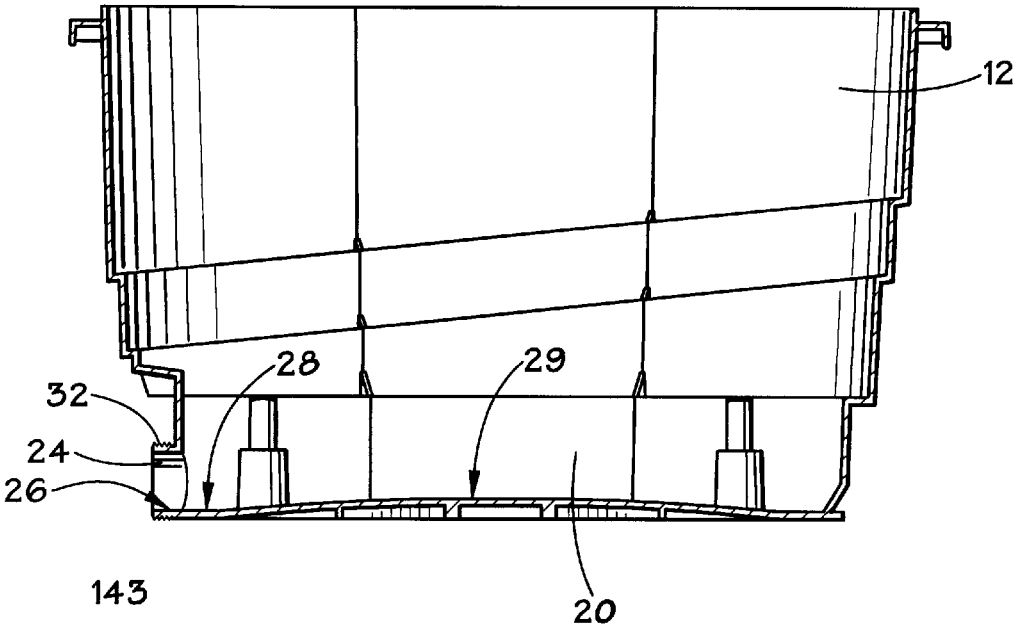
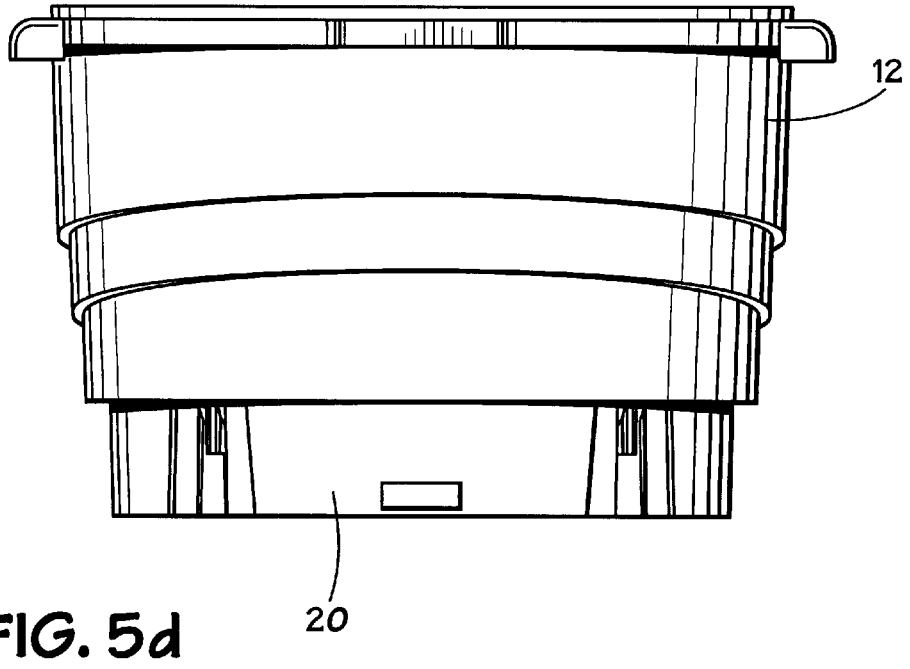
FIG. 5d

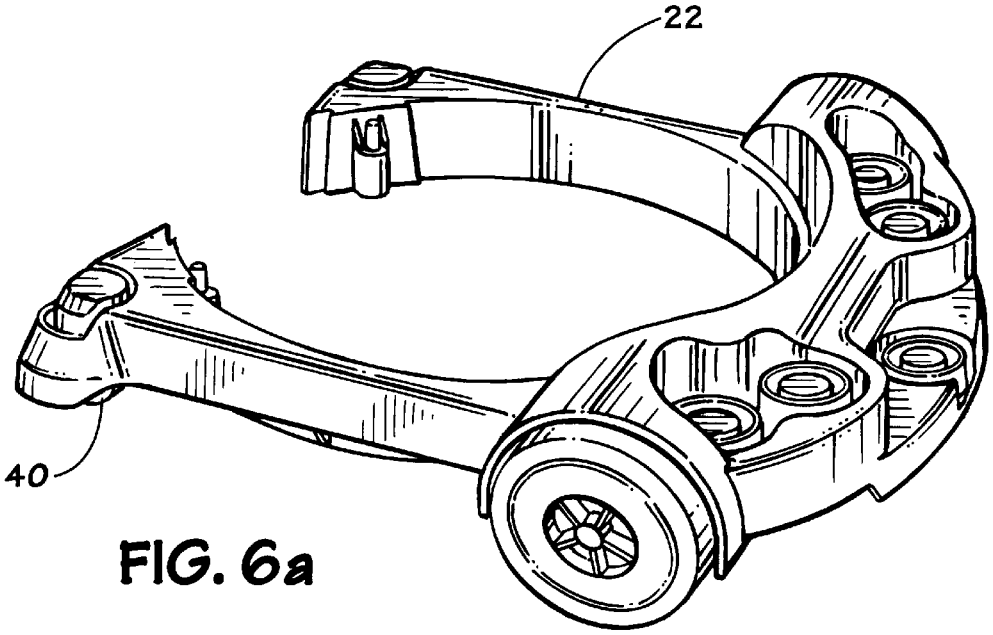
FIG. 6a
FIG. 6b
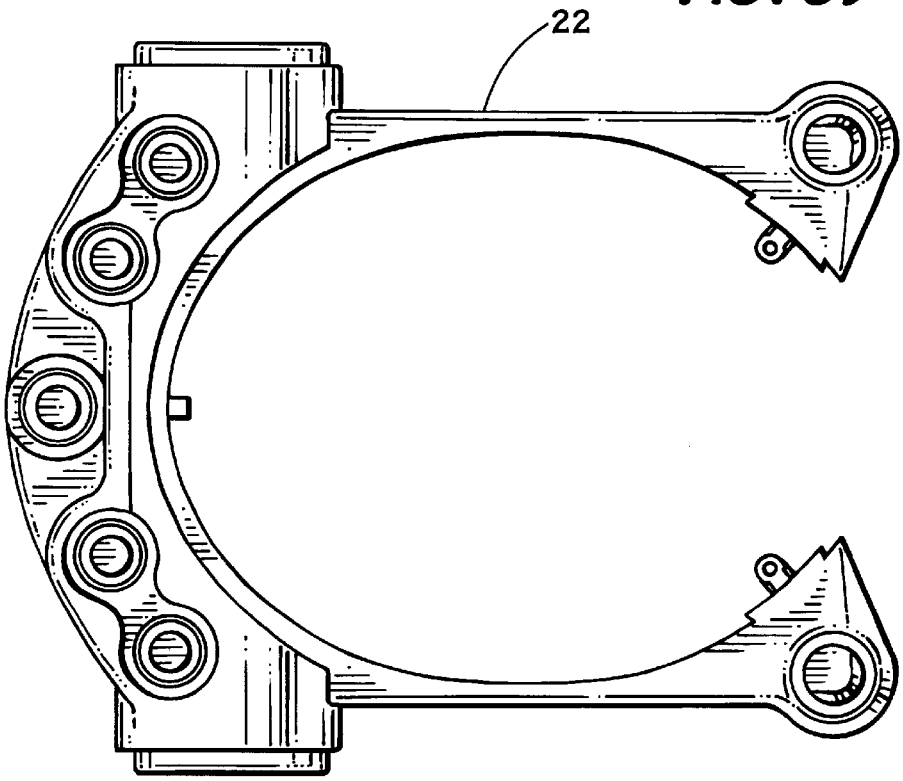

FIG. 7
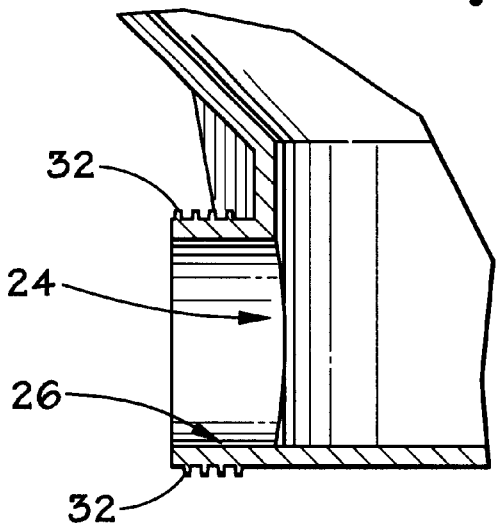
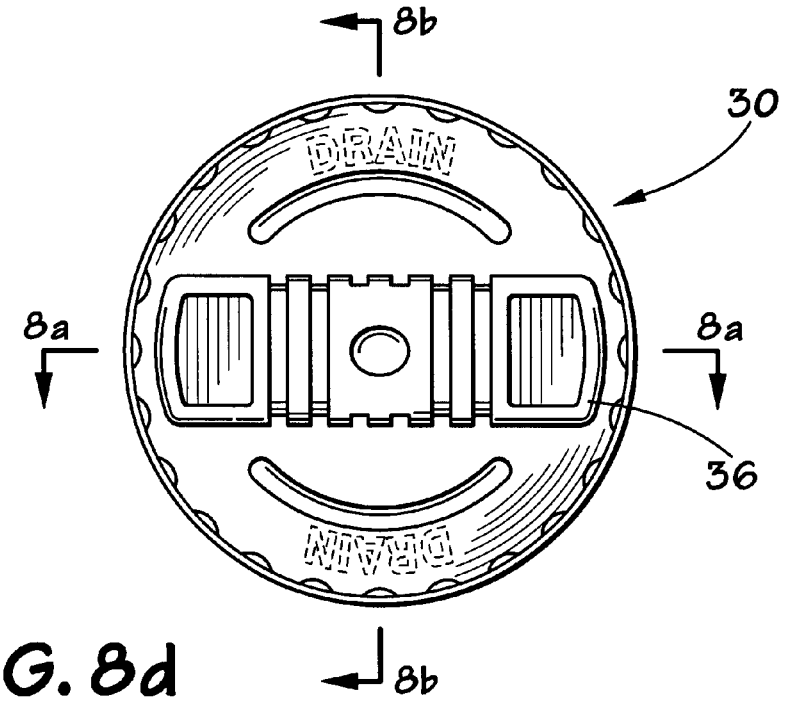
FIG. 8d

FIG. 8a
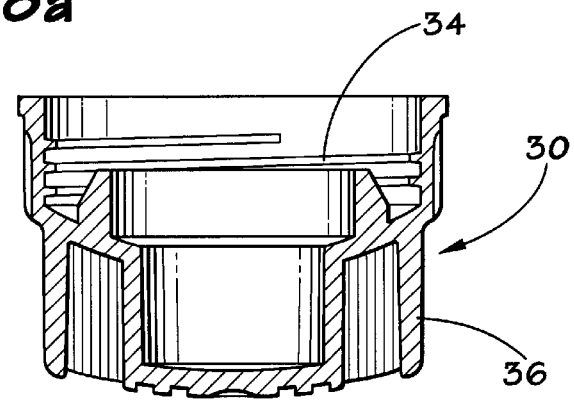
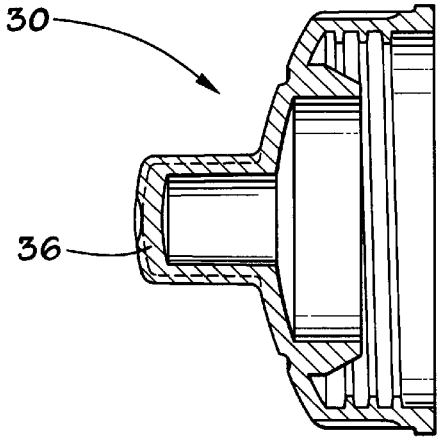
FIG. 8b
FIG. 8c
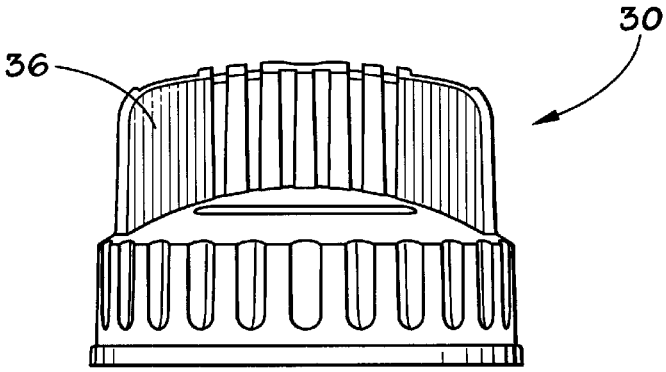

WET/DRY VACUUM DRAIN SYSTEM

This application claims priority of U.S. Provisional Application No. 60/098,578 filed on Aug. 31, 1998 by the same inventors, which is incorporated herein by reference in its entirety.

BACKGROUND OF THE INVENTION

1. Field of the Invention

The present invention relates generally to wet/dry vacuum cleaners, and more specifically, to a drain system for a wet/dry vacuum.

2. Description of Related Art

Vacuum appliances capable of picking up both wet and dry material, commonly referred to as wet/dry vacuums or wet/dry vacs, are often used in workshops and other environments where both wet and dry debris can accumulate. Wet/dry vacs conventionally consist of a collection canister or drum, usually mounted on a dolly having wheels or casters, and a powerhead within which a motor and impeller assembly is mounted. The motor and impeller assembly creates a suction within the drum, such that debris and/or liquid are drawn into the drum through an air inlet to which a flexible hose can be attached. A filter within the drum prevents incoming debris from escaping from the drum while allowing filtered air to escape. Any liquid drawn into the drum is diffused and accumulates on the bottom of the drum. The drum typically includes a drain opening that is stopped by a plug or threaded cap, so that a user can remove the cap to drain accumulated liquid from the drum.

During operation of a wet/dry vac, a user will often pull the wet/dry vac by the hose to move the wet/dry vac to desired locations. Known wet/dry vacs are prone to tip over, for example, as the wet/dry vac is pulled across a door threshold, or even of the vac's own accord as it is being pulled by the hose. This makes many prior-art wet/dry vacs difficult to use in typical wet/dry environments, such as workshops, garages, or basements, where various items may cause the wet/dry vac to tip as it is being pulled by the hose.

Further, draining accumulated liquid from the drum is often problematic in existing wet/dry vacs. As discussed above, the drum typically is mounted on a wheeled dolly by the lower portion of the drum. The drain must therefore be positioned on the drum at a location above the lower portion of the drum that is mounted to the dolly. Thus, to completely empty accumulated fluid from the drum, the entire wet/dry vac must be tipped to allow the fluid to drain.

The present invention addresses shortcomings associated with the prior art.

SUMMARY OF THE INVENTION

In an aspect of the invention, an apparatus and method are provided for a drain system for a wet/dry vacuum, including a generally U-shaped dolly having wheels mounted thereon for rotation and a collection drum having an inside bottom surface defining a plane. The collection drum is adapted to be mounted to the dolly. The system further includes a drain opening on the collection drum. The drain opening is positioned generally opposite the closed end of the U-shaped dolly.

In another aspect of the invention, the system includes a cap having first and second ends; the first end is adapted to mate with the drain opening in a sealed manner. The drain opening defines an inside lower surface. The inside lower surface is generally co-planar with the plane defined by the inside bottom surface of the collection drum.

In further aspect of the invention, the second end of the cap is defined as a member that protrudes from the collection drum. The protruding member has a length sufficient to prevent the collection drum from completely tipping.

In yet another aspect of the invention, the generally U-shaped dolly has first and second ends, wherein the first and second ends of the generally U-shaped dolly have sufficient length to prevent the collection drum from completely tipping. The collection drum is further adapted to be mounted to the dolly at the closed end of the U-shaped dolly such that the first and second ends of the generally U-shaped dolly extend past the collection drum.

In a still further aspect of the invention, the plane of the inside bottom surface of the collection drum defines a raised portion.

BRIEF DESCRIPTION OF THE DRAWINGS

The features and advantages of the present invention will be best appreciated upon reference to the following detailed description and the accompanying drawings, in which:

FIG. 6 illustrates perspective and top views of the U-shaped dolly illustrated in FIG. 1.

FIG. 7 illustrates the drain opening defined by the drum illustrated in FIG. 1.

FIG. 8 illustrates various views of the drain cap in accordance with an embodiment of the invention.

Figure 1:
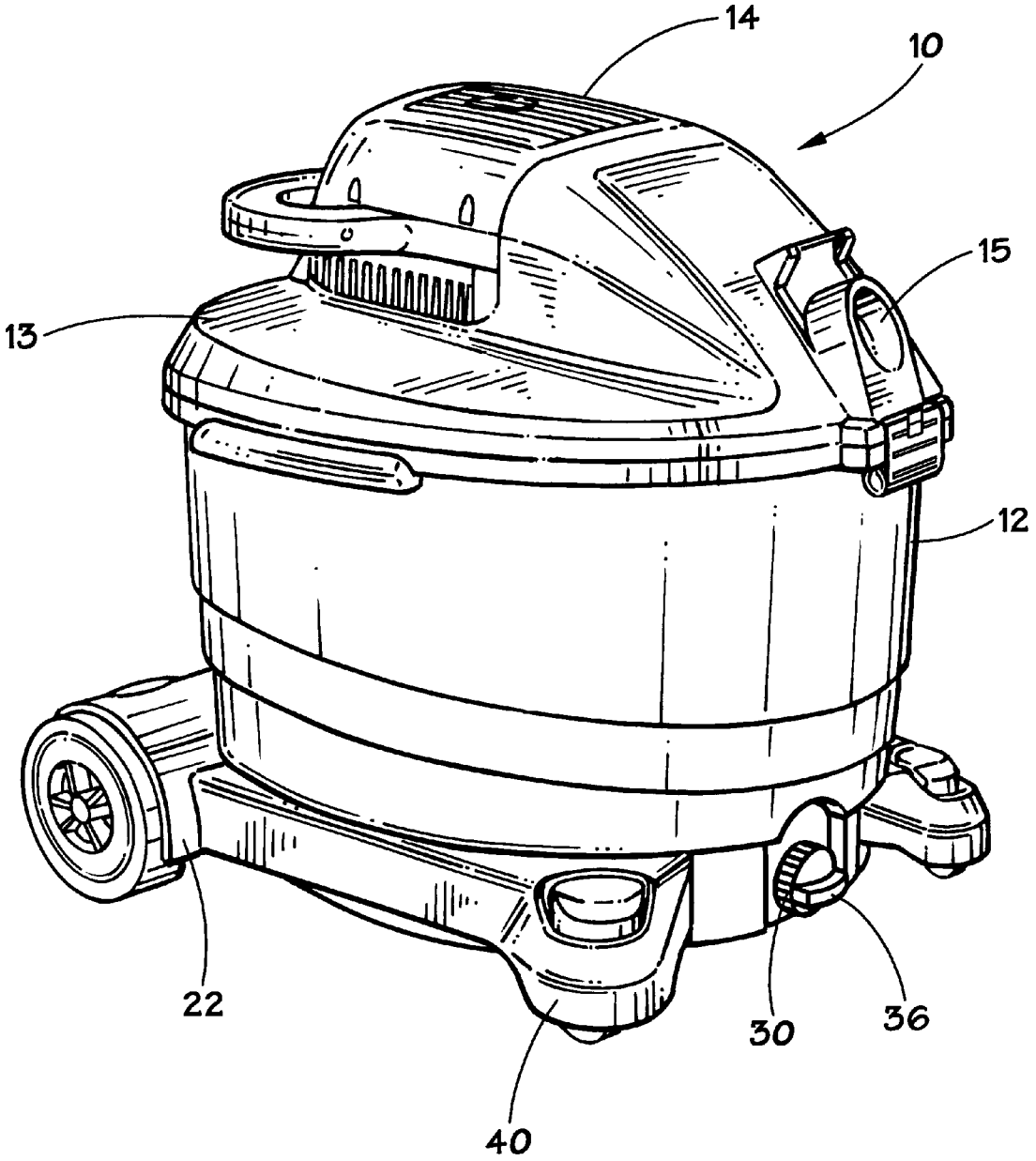
FIG. 1 is a perspective view of a wet/dry vac employing a drain system in accordance with an embodiment of the present invention.
Figure 3:
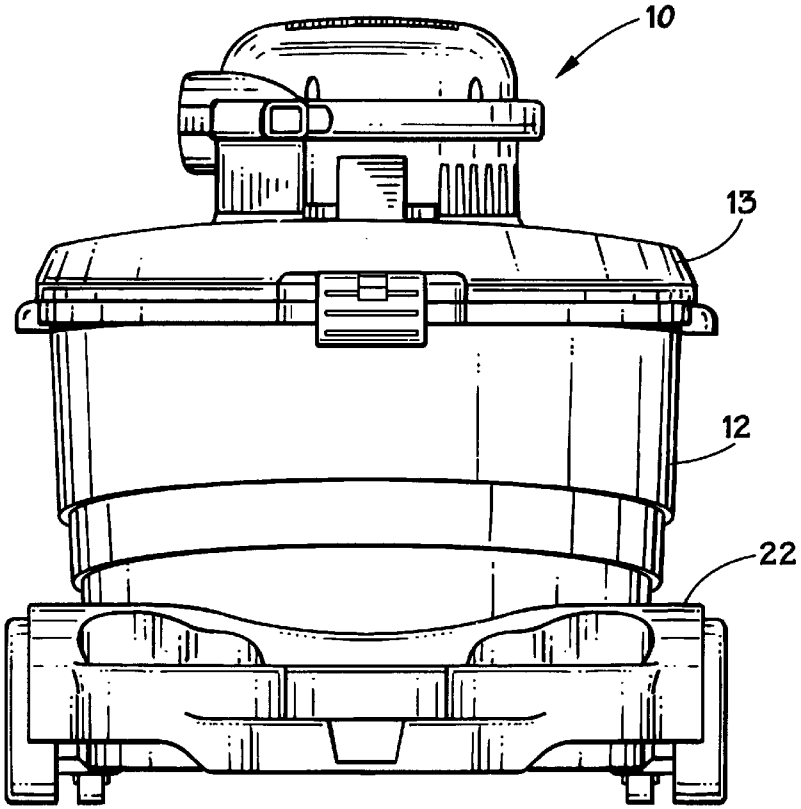
FIGS. 2–4 illustrate various views of the wet/dry vac illustrated in FIG. 1.
Figure 2:
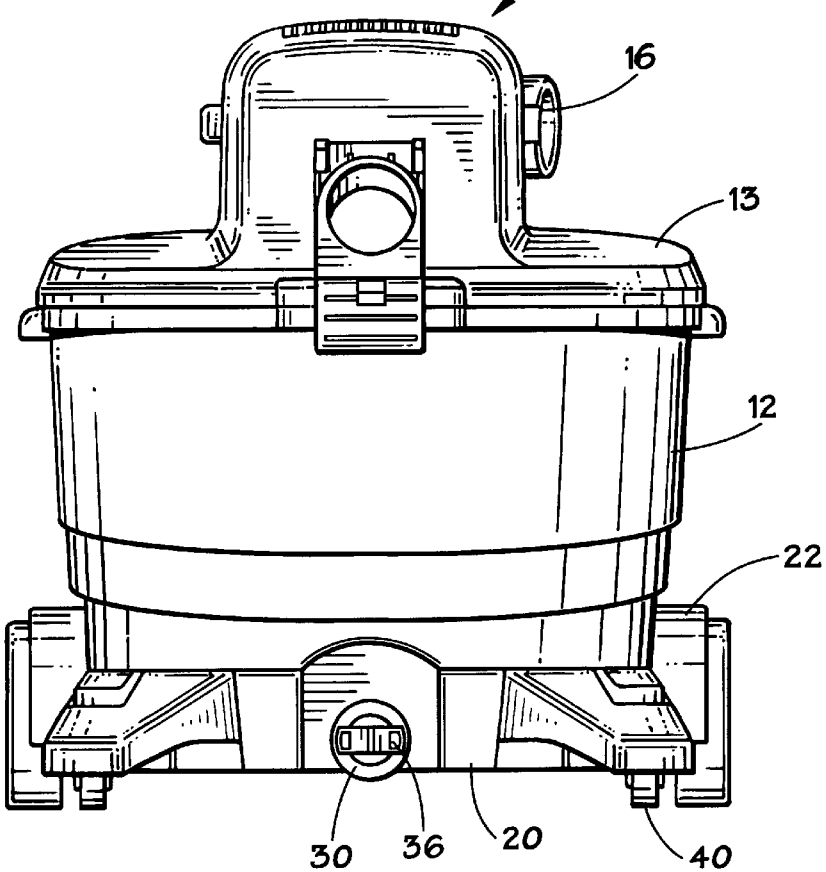

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning to the figures, FIG. 1 illustrates a perspective view of a wet/dry vac 10 employing a drain system in accordance with the present invention. As shown in FIG. 1, the wet/dry vac 10 comprises a collection drum 12 having a lid 13 and a powerhead assembly 14. In the particular embodiment illustrated, the powerhead assembly 14 is detachable from the lid 13. The collection drum 12 illustrated is generally oval-shaped, and both the collection drum 12 and the lid 13 may be made of injection-molded plastic, such as polypropylene or the like, in accordance with conventional practice.

In accordance with conventional designs, an air inlet port 15 is defined in the lid 13 or, alternatively, may be defined in a sidewall of the collection drum 12. The powerhead assembly 14 houses a motor and impeller assembly, and has defined therein an air exhaust or outlet port 16. The powerhead assembly 14 is operable to create a suction within the collection drum 12, such that debris and/or liquid is drawn into the collection drum 12 through a hose (not shown) attached to the inlet port 15.

Figure 5A:
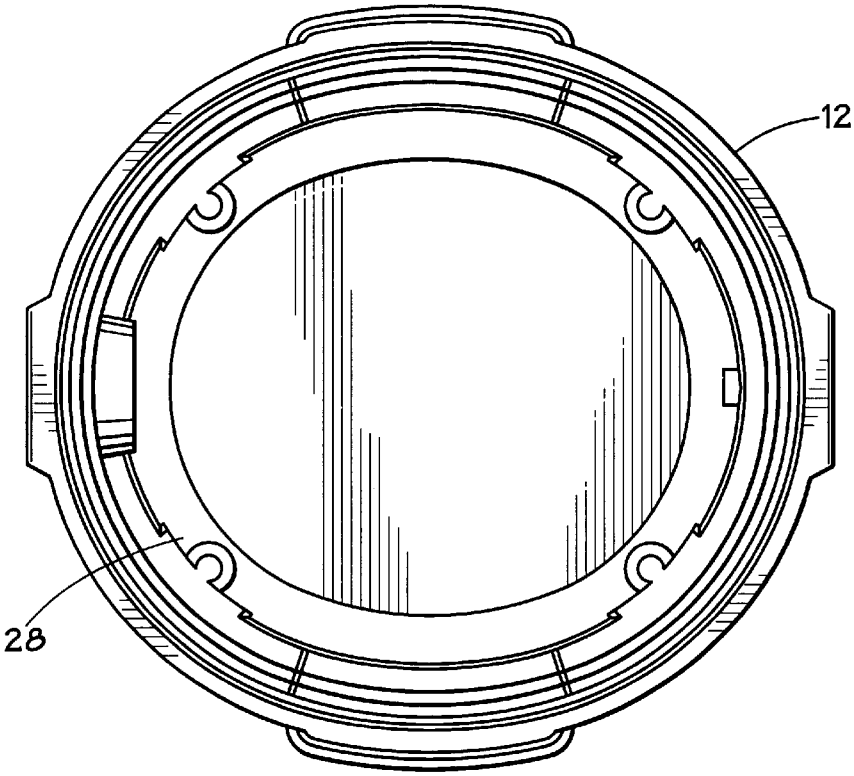
FIG. 5 illustrates various views of the drum of the wet/dry vac illustrated in FIGS. 1 and 2.
Figure 5B:
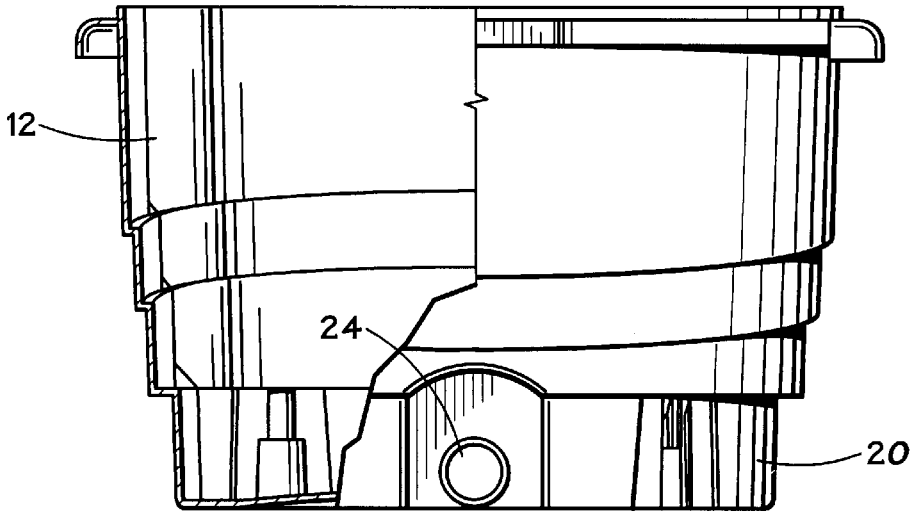

The collection drum 12 is shown in greater detail in FIG. 5. In one embodiment, the drum 12 is non-cylindrical, e.g., oval in shape. Additionally, the drum 12 may have a tapered width with the broadest width at the top and the narrowest width at the bottom. For instance, the longest width of the top portion of the drum may be 21.45 inches while longest width of the bottom portion may be 18 inches. The drum 12 may also have a height of 13.122 inches. Each layer of circumference tends to increase the rigidity of the side walls of drum 12, in the same way that similar bends, folds or corrugations in sheet metal products (e.g., automobile body parts) tend to increase those products' rigidity. This enhances the structural integrity of drum 12.

The collection drum includes a lower portion 20 that is adapted to be mounted to a wheeled dolly 22. The lower portion 20 of the collection drum 12 further defines a drain opening 24 therein to allow a user to drain accumulated fluid from the collection drum 12. The drain opening is illustrated in FIG. 5, and in additional detail in FIG. 7. The drain opening 24 includes a lower surface 26 that is generally co-planar with the bottom inside surface 28 of the drum 12, so that accumulated liquid may be drained from the drum 12 without requiring tilting of the drum 12. In one embodiment, the diameter of the drain opening 24 is 1.545 inches.

In another embodiment, the bottom inside surface 28 defines a raised portion 29 as shown in FIG. 5. The raised portion 29 further enables the accumulated liquid to be drained from the drum 12 without requiring tilting of the drum 12. In accordance with the present invention, the raised portion 29 has a convex shape. In yet another embodiment, the height of the raised portion 29 at the center of the bottom inside surface 28 of the drum 12 is 0.34 inches and gradually decreases to zero as the raised portion 29 reaches the outer edges of the inside bottom surface 28.

The dolly 22 shown in FIG. 1 is configured such that the dolly 22 does not extend completely around the circumference of the lower portion 20 of the drum 12. In the illustrated embodiment, this is accomplished by providing a generally U-shaped dolly 22, as shown in FIG. 6. The open end of the U-shaped dolly 22 is positioned so as to allow the illustrated placement of the drain opening 24. Prior art dollies that extend around the entire circumference of a collection drum necessitate positioning the drain opening higher than the dolly, thus requiring the drum to be tipped to completely empty the contents from the collection drum.

FIG. 8 shows various views of a drain cap 30 in accordance with the present invention. The drain cap 30 is adapted to mate with the drain opening 24 to seal the drain opening 24. In the embodiment illustrated, the drain cap 30 includes an internally threaded portion 34, and the drain opening 24 includes an externally threaded portion 32 adapted such that the drain cap 30 may be threaded onto the drain opening 24 to close the drain opening 24.

Figure 4:
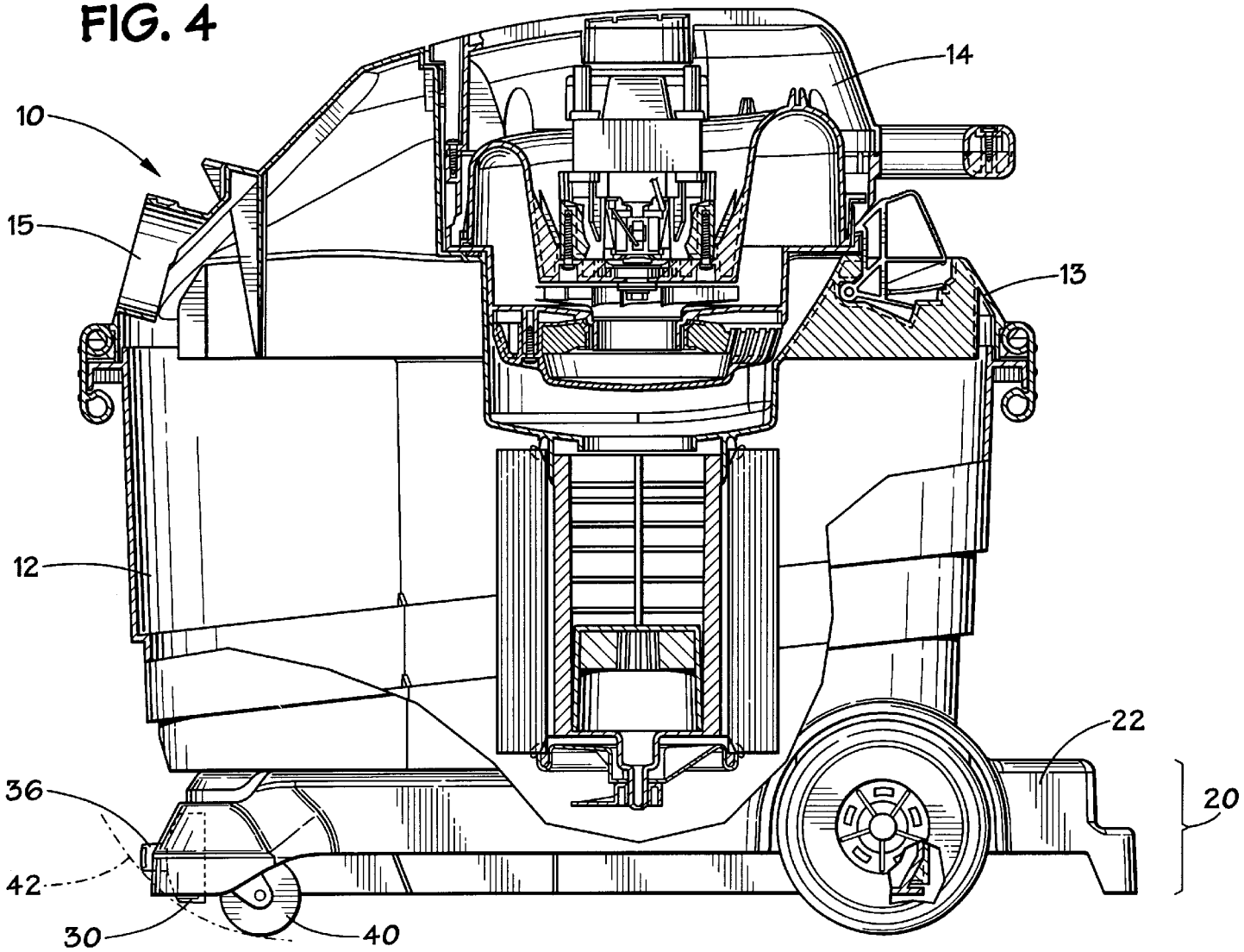

The drain cap 30 further includes a member 36 that protrudes opposite the threaded portion 34. In addition to providing a grip for installing and removing the drain cap 30, the protruding member 36 prevents the wet/dry vac 10 from tipping as it is being moved via the dolly 22. This is made possible, at least in part, by the novel position of the drain opening 24. Referring to FIG. 4, the drum 12 is positioned within the dolly 22 such that the front wheels 40 of the dolly 22 are on either side of the drain opening 24. The protruding member 36 and the front wheels 40 of the dolly 22 form a "tipping radius" indicated by the dashed line labeled with reference 42. Thus, if the wet/dry vac 10 is being pulled by a hose coupled to the inlet port 15 to move the wet/dry vac 10 via the dolly 22, and the forward progress of the wheels 40 is blocked by an article on the floor, such as a door threshold, the wet/dry vac 10 will begin to tip forward. The tip forward motion rotates around the center of the front wheels 40. As the wet/dry vac 10 begins to tip forward, however, the protruding member 36 will contact the floor, preventing the vac 10 from completely tipping, until the wheels on the dolly 22 clear the obstacle, and the wet/dry vac 10 rights itself. In other words, the protruding member 36 has a length that is sufficient to prevent the vac 10 from completely tipping over. In one embodiment, the protruding member 36 further defines a flat tab. In a still further embodiment, the drain cap including the protruding member 36 has a length of 1.58 inches.

The combination of the lower drain opening 24 position and the protruding member 36 of the drain system prevent the wet/dry vac from tipping. Additionally, the distance from the floor (the bottom of the wheels 40) to the drain opening position 24 is determinative in preventing the wet/dry vac 10 from tipping. If the drain opening 24 is too high, the drain cap 30 will not act as a stop in time to prevent the tipping. If the drain opening 24 is too low, the drain cap 30 will strike the obstacle (cord, door threshold, etc.) that caused the vac 10 to tip.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above might be altered or modified and all such variations are considered within the scope and spirit of the invention.

What is claimed is:

1. A drain system for a wet/dry vacuum, comprising:

a generally U-shaped dolly having wheels mounted thereon;

a collection drum having an inside bottom surface defining a plane, the collection drum being removably mounted to the dolly; and a drain opening defined by the collection drum, the drain opening being positioned generally opposite the closed end of the U-shaped dolly, wherein the drain opening defines an inside lower surface, the inside lower surface generally co-planar with the plane defined by the inside bottom surface of the collection drum.

2. The drain system of claim 1, wherein the inside bottom surface of the collection drum defines a convex floor.

3. The drain system of claim 1, wherein a lower portion of the collection drum is removably mounted to the dolly.

4. The drain system of claim 1, further comprising a cap having first and second ends, the first end adapted to removably seal the drain opening.

5. The drain system of claim 4, wherein the second end of the cap defines a protruding member.

6. The drain system of claim 5, wherein the protruding member has a length sufficient to prevent the collection drum from tipping over.

7. The drain system of claim 4, wherein the second end of the cap defines a flat tab.

8. The drain system of claim 4, wherein the second end provides a grip for installing and removing the cap.

9. A drain system for a wet/dry vacuum, comprising:

a dolly having wheels mounted thereon;

a collection drum being adapted to removably mount on the dolly;

a drain opening defined by the collection drum; and a cap having first and second ends, the first end being adapted to mate with the drain opening in a sealed manner, the second end defining a protruding member, wherein the protruding member has a length sufficient to prevent the collection drum from tipping over.

10. The drain system of claim 9, wherein the protruding member and front wheels form a tipping radius to prevent the collection drum from tipping over.

11. A method of draining the contents of a wet/dry vacuum, comprising:

mounting a collection drum having an inside bottom surface to a generally U-shaped dolly, wherein the inside bottom surface defining a plane;

defining a drain opening on the collection drum generally opposite the closed end of the U-shaped dolly, wherein the drain opening defines an inside lower surface, the inside lower surface is generally co-planar with the plane defining the inside bottom surface of the collection drum;

covering the drain opening with a cap, the cap having first and second ends, the first end adapted to mate with the drain opening in a sealed manner; and opening the cap of the drain opening.

12. The method of claim 11, wherein the plane defined by the inside bottom surface of the collection drum defines a convex floor.

13. The method of claim 12, further comprising defining a protruding member at the second end of the cap.

14. The method of claim 13, wherein the protruding member has a length sufficient to prevent the collection drum from tipping over.

15. The method of claim 11, wherein the second end of the cap provides a flat tab grip for installing and removing the cap.

16. The method of claim 12, further comprising: mounting the collection drum at the closed end of the generally U-shaped dolly; and defining extending members at the open end of the dolly, wherein the extending members extend past the collection drum.

17. The method of claim 16, wherein the extending members at the open end of the generally U-shaped dolly have sufficient length to prevent the collection drum from tipping over.

18. A drain system for a wet/dry vacuum, comprising:

a generally U-shaped dolly having wheels mounted thereon;

a collection drum being removably mounted to the dolly;

a drain opening defined by the collection drum, the drain opening being positioned generally opposite the closed end of the U-shaped dolly; and a cap having first and second ends, the first end being adapted to removably seal the drain opening, wherein the second end of the cap defines a flat tab.

* * * * *